US009630068B2

(12) United States Patent
Beach et al.

(10) Patent No.: US 9,630,068 B2
(45) Date of Patent: Apr. 25, 2017

(54) GOLF CLUB

(71) Applicant: Taylor Made Golf Company, Inc., Carlsbad, CA (US)

(72) Inventors: Todd P. Beach, Encinitas, CA (US); Michael Robert Peters, Vista, CA (US); Justin David Kleinert, San Clemente, CA (US); John Bernard Krzywiec, Oceanside, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

(21) Appl. No.: 14/803,735

(22) Filed: Jul. 20, 2015

(65) Prior Publication Data

US 2016/0067562 A1 Mar. 10, 2016

Related U.S. Application Data

(60) Provisional application No. 62/046,013, filed on Sep. 4, 2014.

(51) Int. Cl.
*A63B 53/04* (2015.01)

(52) U.S. Cl.
CPC .. *A63B 53/0466* (2013.01); *A63B 2053/0412* (2013.01); *A63B 2053/0416* (2013.01); *A63B 2053/0433* (2013.01); *A63B 2209/02* (2013.01)

(58) Field of Classification Search
CPC ..... A63B 53/0466; A63B 2053/0433; A63B 2053/0412
See application file for complete search history.

(56) References Cited

U.S. PATENT DOCUMENTS

| | | | | | |
|---|---|---|---|---|---|
| 1,946,208 | A * | 2/1934 | Hampton | A63B 53/0466 | 427/271 |
| D245,720 | S | 9/1977 | Romero | | |
| 4,396,672 | A | 8/1983 | Adesko | | |
| 4,532,170 | A | 7/1985 | O'Dell et al. | | |
| 5,273,283 | A * | 12/1993 | Bowland | A63B 53/04 | 473/338 |
| 5,851,160 | A * | 12/1998 | Rugge | A63B 53/04 | 473/346 |
| 6,093,113 | A * | 7/2000 | Mertens | A63B 53/04 | 473/328 |

(Continued)

OTHER PUBLICATIONS

Ex parte Hess, Appeal 2009-1134 (BPAI 2009), (citing Keating, "Hidden design dimensions: What the experts know about color", www.swingweight.com/hidden_dimensions.htm, (May 1, 2000). as cited in Hess et al., U.S. Publication No. 2003/0207722.

(Continued)

*Primary Examiner* — John E Simms, Jr.
(74) *Attorney, Agent, or Firm* — Klarquist Sparkman, LLP

(57) ABSTRACT

A golf club head includes a golf club body, the golf club body including a toe portion and a heel portion, the golf club body including a hosel connected to the heel portion, the golf club body defining an external surface area, thereby each portion of the golf club body including a contributing external surface area to the total external surface area of the golf club body; a face connected to a front of the golf club body; a surface covering applied to at least 50% of the sole.

20 Claims, 5 Drawing Sheets

(56) References Cited

U.S. PATENT DOCUMENTS

| | | | | |
|---|---|---|---|---|
| 6,482,107 | B1 * | 11/2002 | Urbanski | A63B 53/04 473/331 |
| D502,520 | S | 3/2005 | Dogan | |
| D515,642 | S | 2/2006 | Antonious | |
| 8,870,679 | B2 * | 10/2014 | Oldknow | A63B 53/06 473/335 |
| 2001/0055995 | A1 * | 12/2001 | Cackett | A63B 53/02 473/342 |
| 2002/0072433 | A1 | 6/2002 | Galloway et al. | |
| 2002/0077195 | A1 * | 6/2002 | Carr | A63B 53/04 473/328 |
| 2002/0136862 | A1 | 9/2002 | Dong et al. | |
| 2002/0168503 | A1 | 11/2002 | Dong et al. | |
| 2003/0035917 | A1 | 2/2003 | Hyman | |
| 2003/0207722 | A1 | 11/2003 | Hess et al. | |
| 2005/0166783 | A1 | 8/2005 | Ylitalo et al. | |
| 2006/0003114 | A1 | 1/2006 | Enlow et al. | |
| 2006/0157195 | A1 | 7/2006 | Laurence et al. | |
| 2007/0287004 | A1 | 12/2007 | Gottzmann et al. | |
| 2008/0081711 | A1 * | 4/2008 | Chauvin | A63B 49/14 473/457 |
| 2008/0085396 | A1 | 4/2008 | Bober et al. | |
| 2008/0096682 | A1 * | 4/2008 | Fox | A63B 53/0487 473/251 |
| 2009/0203462 | A1 * | 8/2009 | Stites | A63B 53/0466 473/334 |
| 2011/0077103 | A1 * | 3/2011 | Galloway, Sr. | A63B 53/047 473/350 |
| 2013/0130830 | A1 * | 5/2013 | Boyd | A63B 53/0466 473/345 |
| 2013/0324290 | A1 * | 12/2013 | Oldknow | A63B 53/0466 473/324 |
| 2015/0375066 | A1 * | 12/2015 | Mizutani | A63B 53/0466 473/335 |

OTHER PUBLICATIONS

Keating, http://blog.myostrichgolf.com/blog/_archives/2006/10/15/2419297.html, (Oct. 15, 2006), originally published on www.swingweight.com.

* cited by examiner

GOLF CLUB

CROSS REFERENCE TO RELATED APPLICATION

This application claims the benefit of U.S. Provisional Application No. 62/046,013, which was filed on Sep. 4, 2014, and is incorporated herein by reference in its entirety. This application references Application for U.S. Patent bearing Ser. No. 13/839,727, entitled "GOLF CLUB WITH COEFFICIENT OF RESTITUTION FEATURE," filed Mar. 15, 2013, which is incorporated by reference herein in its entirety and with specific reference to discussion of coefficient of restitution features. This application also references Application for U.S. Patent bearing Ser. No. 14/457,883, entitled "GOLF CLUB," filed Aug. 12, 2014, which is incorporated by reference herein in its entirety and with specific reference to discussion of boundary condition features.

TECHNICAL FIELD

This disclosure relates to manufacture and design of golf club heads. More specifically, this disclosure relates to golf club head surface coverings

SUMMARY

A golf club head includes a golf club body, the golf club body including a toe portion and a heel portion, the golf club body including a hosel connected to the heel portion, the golf club body defining an external surface area, thereby each portion of the golf club body including a contributing external surface area to the total external surface area of the golf club body; a face connected to a front of the golf club body; a surface covering applied to at least 50% of the sole.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
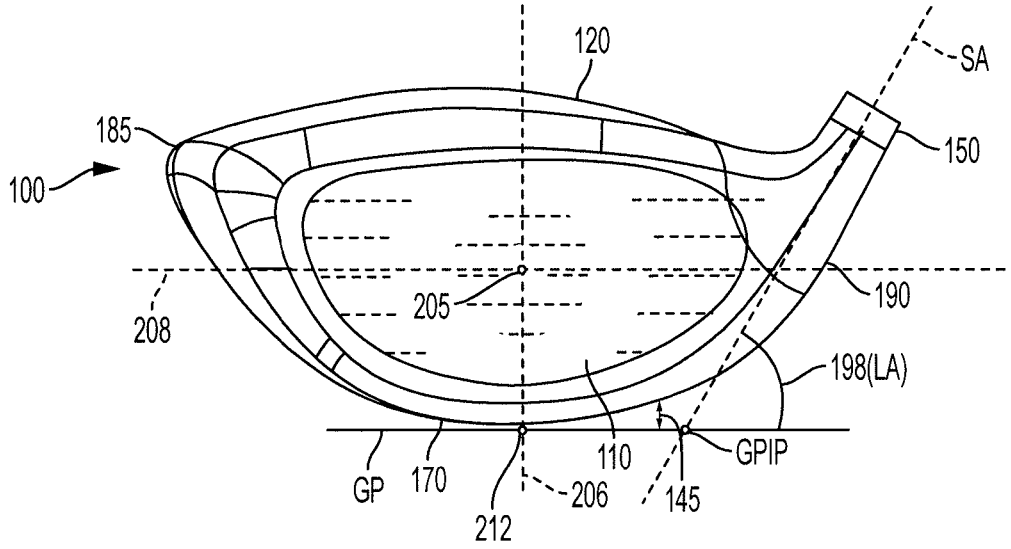
FIG. 1A is a front side view of a golf club head in accord with one embodiment of the current disclosure.

Since the inception of metal wood golf club heads, golf clubs have included surface coverings such as paint covering crown portions of the golf club head. For many clubs, cosmetics on the crown were as far as reasonably possible. Although some cosmetic features were includable on the sole of the golf club head, these generally were things that could not be destroyed through normal use, such as engraving, embossing, or recessing features. Additionally, the sole of the golf club head is often used to influence the turf interaction of the golf club head, and, as such, cosmetic features on the sole often took a back seat to playability of the golf club.

As technology progressed, more and more features were included on golf club heads not only for playability but also for visual distinction. For example, the TaylorMade R11 driver included a white-painted golf club head. The R11 driver's white paint allowed players to align the driver to its target more effectively than prior club heads, but the white paint also allowed the TaylorMade R11 driver to be visually distinguishable from other clubs. The result was a driver that was better performing, commercially distinguishable, and—to some golfers—more aesthetically pleasing.

Often times, to provide distinction in the marketplace, golf club heads include visual features to distinguish certain clubs over the competition. As such, adding new and interesting cosmetics in new and interesting places has become a valuable tool in garnering interest for golf club heads.

However, certain cosmetics can provide a camouflage function as well. In casting titanium and steel, it is common to experience porosities in the castings. Porosities can occur through a variety of errors, such as gas dissolution, pouring defects, temperature gradients, compounding defects, material impurities, and more. Once a part is produced, however, it can be costly to turn the part into scrap.

With golf club heads, this becomes a cosmetic issue. Porosities on the crown of the golf club head are visible to the player at address if they are not covered. It is possible to weld over these porosities, but such a process can create increased labor costs and cycle times. One process allows the porosities to be filled with a putty or resin material before coating with paint or applying another surface covering. Using a filler material as described provides a smooth paint surface over the porosity with lower labor costs and lower cycle times. However, labor still must be utilized, and the process is not applicable for areas on the sole of the golf club head for many models because many models of golf club heads include soles with large portions of metal exposed. If a porosity occurs along the sole of the golf club head, it will be ineffective to use putty or resin material if the sole is not covered with paint. Unless discussed otherwise, one of skill in the art would understand that references to "paint" and to "decal" are intended to be interchangeable when referring to areas of coverage in the current disclosure. In various embodiments, the area into which paint may be placed is coincident with the area into which a decal may be placed. For some portions of the disclosure, one of skill in the art would understand the need to differentiate between decals and paint—for example, when discussing texturing applications, certain textures may be unattainable with paint. As such, all surface coverings including decals and paint should be included as coincident within the disclosure.

Often times, manufacturers of golf club heads leave the sole of the golf club head bare because of turf interaction. In general, golf clubs are meant to be struck with the sole portion in close proximity to the ground. Because of the speed of the usual golf club swing, most paints and coverings are not of sufficient strength to remain durable and withstand the impact of the ground repeatedly at very high speed. As such, rather than attempt to paint an entire golf club sole, most club makers have opted to leave portions of the sole raw—or covered in clear coat only—to avoid the potential problems of scratched, chipped, and dulled paint on the sole. However, as previously mentioned, porosities can occur in the bare locations on the sole. In such locations, welding steps may be necessary to hide the porosities.

The golf club heads of the current disclosure provide a novel solution to these problems for at least two reasons. First, cosmetically, they allow greater portions of the sole to be covered with cosmetics than in many prior designs, creating a larger canvas on which club designers can create visually distinctive products, as well as other cosmetic options. Second, paint, decals, and other surface coverings may be used to cover porosities without welding, reducing cycle times and labor costs. In another aspect of the current disclosure, certain types of coverings can provide surface texture to the golf club head, providing a visual camouflage of the porosities. As such, with certain aspects of the current disclosure, repair of any type to the porosities may be unnecessary, thereby further reducing labor costs and cycle times. The current disclosure includes golf club heads and methods, systems, and various apparatus to address the issues described above.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads usually have lofts of greater than 14 degrees. In general, driver type golf club heads have lofts of 14 degrees or less, and, more usually, 12 degrees or less. In general, fairway wood type golf club heads have a length from leading edge to trailing edge of 73-97 mm. Various definitions distinguish a fairway wood type golf club head form a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure preferably are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Additionally, most fairway wood type golf club heads are between 150 cc and 250 cc in volume as measured according to methods of the USGA. See U.S.G.A. "Procedure for Measuring the Club Head Size of Wood Clubs," Revision 1.0.0, Nov. 21, 2003, for the methodology to measure the volume of a wood-type golf club head. Exemplary fairway wood type golf club heads of the current disclosure may be between 180 cc and 240 cc. In various embodiments, fairway wood type golf club heads of the current disclosure are between 200 cc and 220 cc. Driver type golf club heads of the current disclosure preferably are 12 degrees or less of loft in various embodiments. Driver type golf club heads of the current disclosure may be 10.5 degrees or less in various embodiments. Driver type golf club heads of the current disclosure may be between 9 degrees and 14 degrees of loft in various embodiments. In various embodiments, driver type golf club heads may be as much as 16 degrees of loft. Additionally, most driver-type golf club heads are over 375 cc in volume. Exemplary driver-type golf club heads of the current disclosure may be over 425 cc in volume. In some embodiments, driver-type golf club heads of the current disclosure are between 440 cc and 460 cc in volume.

Figure 1B:
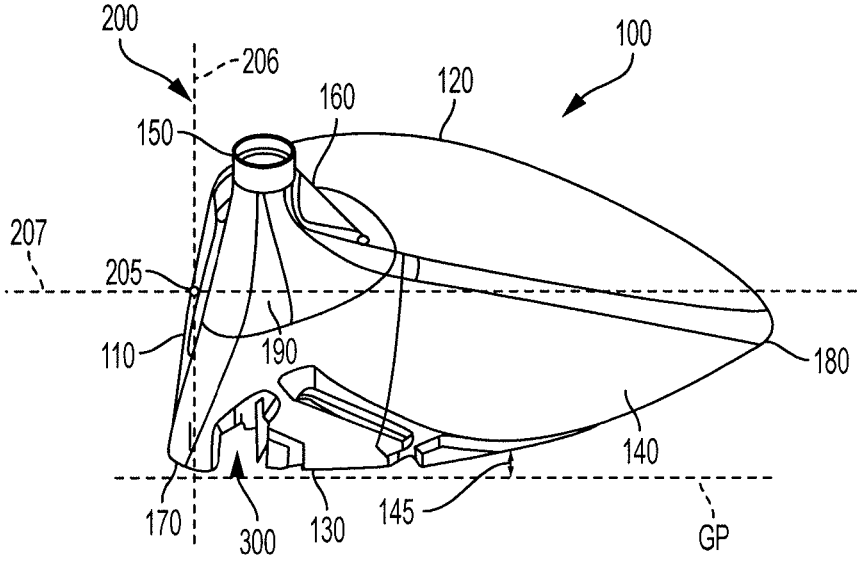
FIG. 1B is a heel side view of the golf club head of FIG. 1A.
Figure 1C:
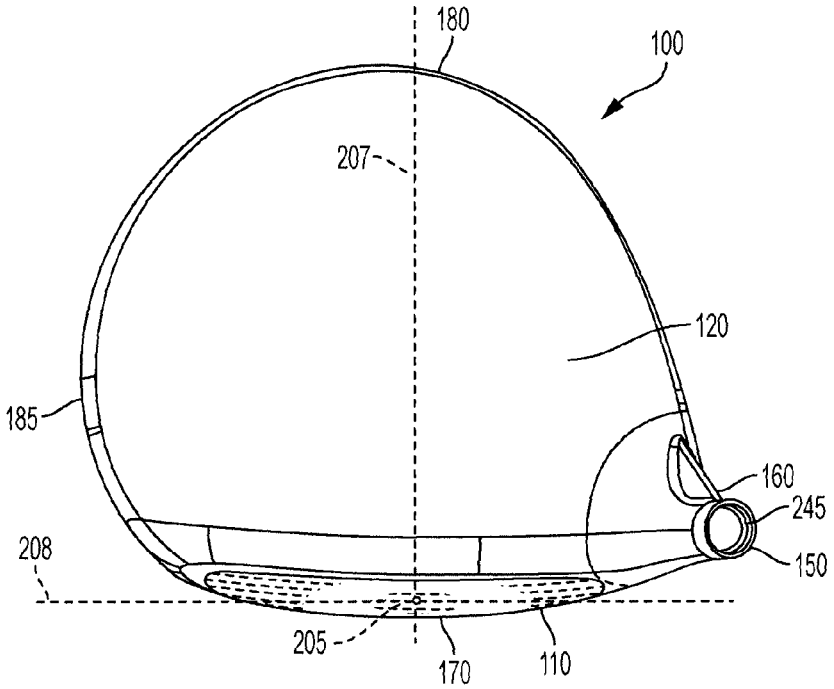
FIG. 1C is a top view of the golf club head of FIG. 1A.

As seen with reference to FIGS. 1A-1C, a golf club head 100 is shown. The golf club head 100 includes a face 110, a crown 120, a sole 130, a skirt 140 (also referred to as a "ribbon"), a hosel 150 located proximate a heel 190, a toe 185, a leading edge 170, and a trailing edge 180. The golf club head 100 includes a gusset 160 connecting the hosel 150 to the crown 120 proximate the heel 190 in the current embodiment. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208. Each axis 206,207,208 is orthogonal to each other axis 206,207, 208.

The x-axis 208 is parallel to a ground plane (GP) onto which the golf club head 100 may be properly soled—arranged so that the sole 130 is in contact with the GP. The y-axis 207 is also parallel to the GP and is orthogonal to the x-axis 208. The z-axis 206 is orthogonal to the x-axis 208, the y-axis 207, and the GP. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used a point of reference from which features of the golf club head 100 may be measured or referenced. The SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The golf club head 100 includes a boundary condition feature 300 defined in the sole 130 of the golf club head 100. Boundary condition features are described in more detail with reference to Application for U.S. Patent bearing Ser. No. 13/839,727, entitled "GOLF CLUB WITH COEFFICIENT OF RESTITUTION FEATURE," filed Mar. 15, 2013, and Application for U.S. Patent bearing Ser. No. 14/457,883, entitled "GOLF CLUB," filed Aug. 12, 2014, both of which are incorporated by reference herein in their entirety.

Golf club heads of the current disclosure provide a solution to the problems cited previously in this disclosure by limiting sole wear and interaction to a reliably small location. The disclosure also provides a procedure allowing for design of a golf club head to have maximum sole coverage of paint, decals, and/or other surface coverings, thereby reducing input labor costs and enhancing the cosmetic appeal of the golf club head.

Golf club heads such as golf club head 100 are designed to provide minimum interaction of the sole 130 with the turf. Many golf clubs are not designed for paint below their ribbon areas. As such, many golf clubs leave the soles entirely bare, save for some paint on the ribbon or skirt areas. In addition, many golf club heads have "recessed" areas located in soles providing grooves or areas in which to catch paint and protect it from turf interaction.

However, as has been unexpectedly discovered, the golf club head 100 is designed for maximum sole coverage of surface covering by creating minimum turf interaction. These two things are correlated because regions of the sole in closest proximity to the ground are the ones that tend to make contact the most.

In general, various regions of the golf club head 100 are within a distance 145 of the GP. Determining a distance 145 at which the sole 130 minimizes turf interaction can aid in designing a golf club head for maximum cosmetic sole coverage. In various embodiments, when the distance 145 is sufficiently large, a golf club designer can predict where the sole 130 will experience interaction with the ground.

Figure 2:
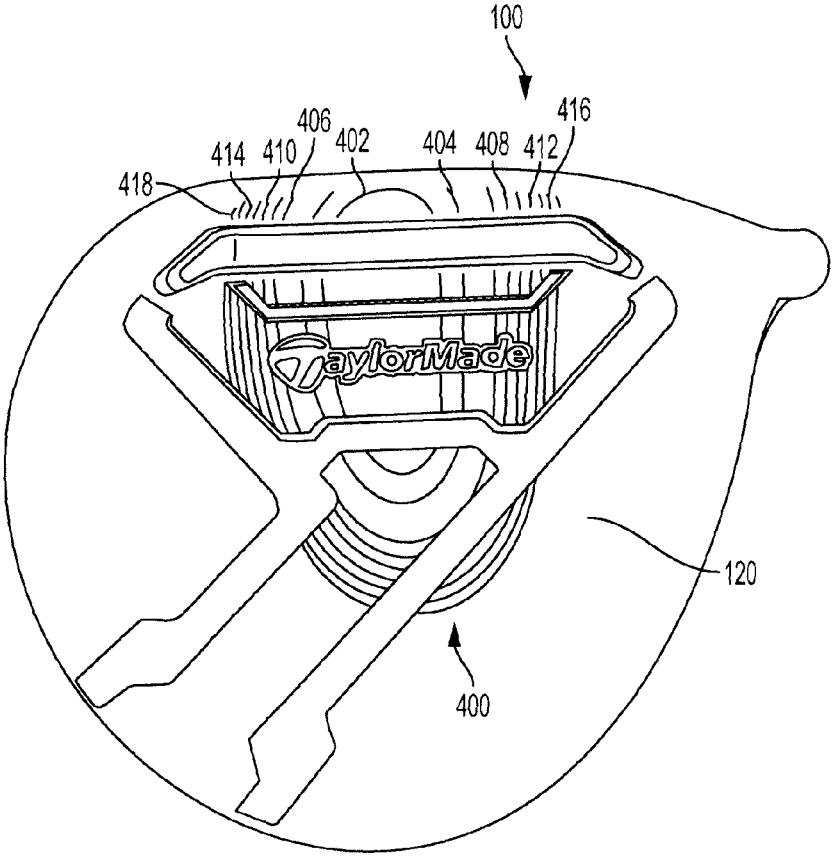
FIG. 2 is a bottom view of the golf club head of FIG. 1A including a contour plot.

As seen with reference to FIG. 2, the golf club head 100 is shown including a contour plot 400 showing the distance 145 of the surface of the golf club head 100 above the GP falls at specific ranges. Areas within a particular region are closer to the GP than the distance 145, and areas outside the region are further from the GP than the distance 145. All areas within a first region 402 of the contour plot 400 are within 0.5 mm of the GP when the golf club head 100 is properly soled (as seen in FIG. 1A). All areas within a second region 404 of the contour plot 400 are within 1.0 mm of the GP when the golf club head 100 is properly soled. All areas within a region 406 are within 1.5 mm of the GP. All areas within region 408 are within 2.0 mm of the GP. All areas within region 410 are within 2.5 mm of the GP. All areas within region 412 are within 3.0 mm of the GP. All areas within region 414 are within 3.5 mm of the GP. All areas within region 416 are within 4.0 mm of the GP. All areas within region 418 are within 4.5 mm of the GP.

The LA 198 of the golf club head 100 is typically around 60° for a driver-type golf club head. However, many golfers use golf clubs in orientations other than 60°. In some cases, a golfer may grip the club in an upright position, while other golfers may grip the club in a flat position. For example, some golfers may use the club at 65°, while others may use the club at 55°. As such, it is important to allow for variations in the golfer's holding position when considering the portion of the sole 130 that should be covered.

In various embodiments, the golf club head 100 may be painted or decaled to various areas with various confidence levels as to the ability to avoid wear in such regions. In general, areas of the sole 130 that are outside of the region 404 within 1.0 mm of the GP are sufficiently removed from the GP for a surface covering such as paint or decal. In various embodiments, areas outside of the region 406 within 1.5 mm of the GP are sufficiently removed from the GP for a surface covering such as paint or decal. In various embodiments, areas outside of the region 408 within 2.0 mm of the GP are sufficiently removed from the GP for a surface covering such as paint or decal.

A golf club designer may choose various regions outside of which the golf club head would experience turf interaction. For example, in some embodiments, areas outside of 1.0 mm may experience sufficiently small turf interaction to allow coverage for all areas outside of 1.0 mm. In another example, it may be found that areas inside 1.5 mm experience too much turf interaction to allow paint or decal coverage.

Figure 3A:
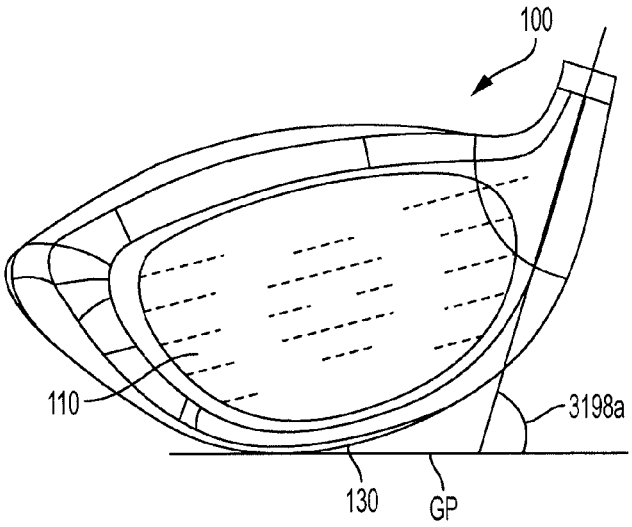
FIG. 3A is a front side view of the golf club head of FIG. 1A in a testing orientation in accord with one embodiment of the current disclosure.
Figure 3B:
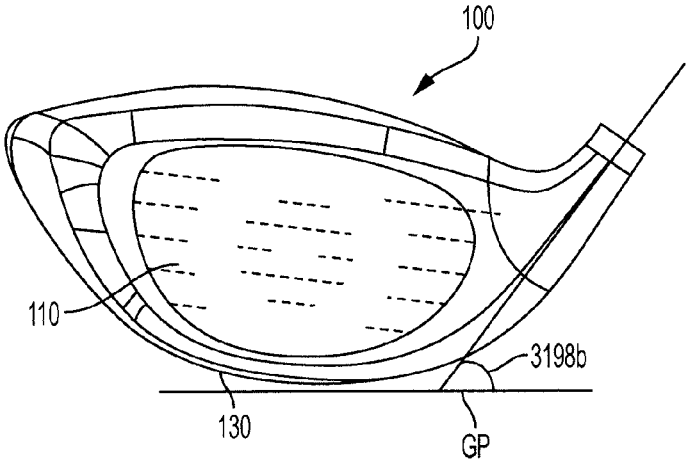
FIG. 3B is a front side view of the golf club head of FIG. 1A in a testing orientation in accord with one embodiment of the current disclosure.
Figure 3C:
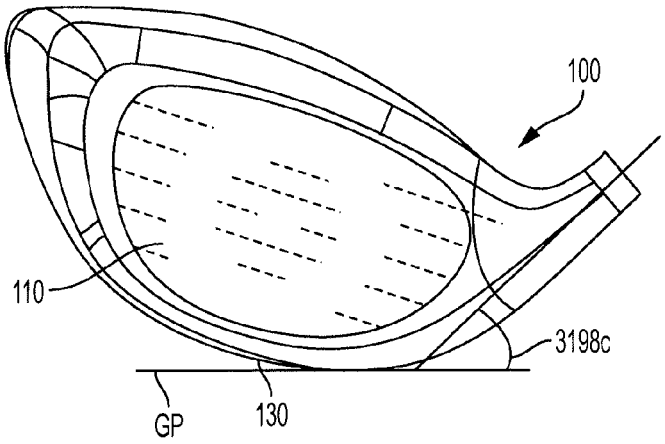
FIG. 3C is a front side view of the golf club head of FIG. 1A in a testing orientation in accord with one embodiment of the current disclosure.

As seen with reference to FIGS. 3A-3C, an analysis is performed on the golf club head 100 to determine contact points of the sole 130 with the GP along a variety of lie angles. As seen with reference to FIG. 3A, the golf club head 100 is shown soled at an upright-most lie angle 3198*a*. For testing, the upright-most lie angle 3198*a* is about 67°. As seen with reference to FIG. 3B, the golf club head 100 is seen soled at an intermediate lie angle 3198*b*, which is about 56°. As seen with reference to FIG. 3C, the golf club head 100 is seen soled at a flattest lie angle 3198*c*, which is about 27° in the current embodiment. For sole contact testing, the LA 198 is swept from the flattest lie angle 3198*c* to the upright-most lie angle 3198*a* in 0.4° increments. For each LA, the contact points of the sole 130 are mapped. The result of the LA sweep is seen with reference to FIG. 4.

Figure 4:
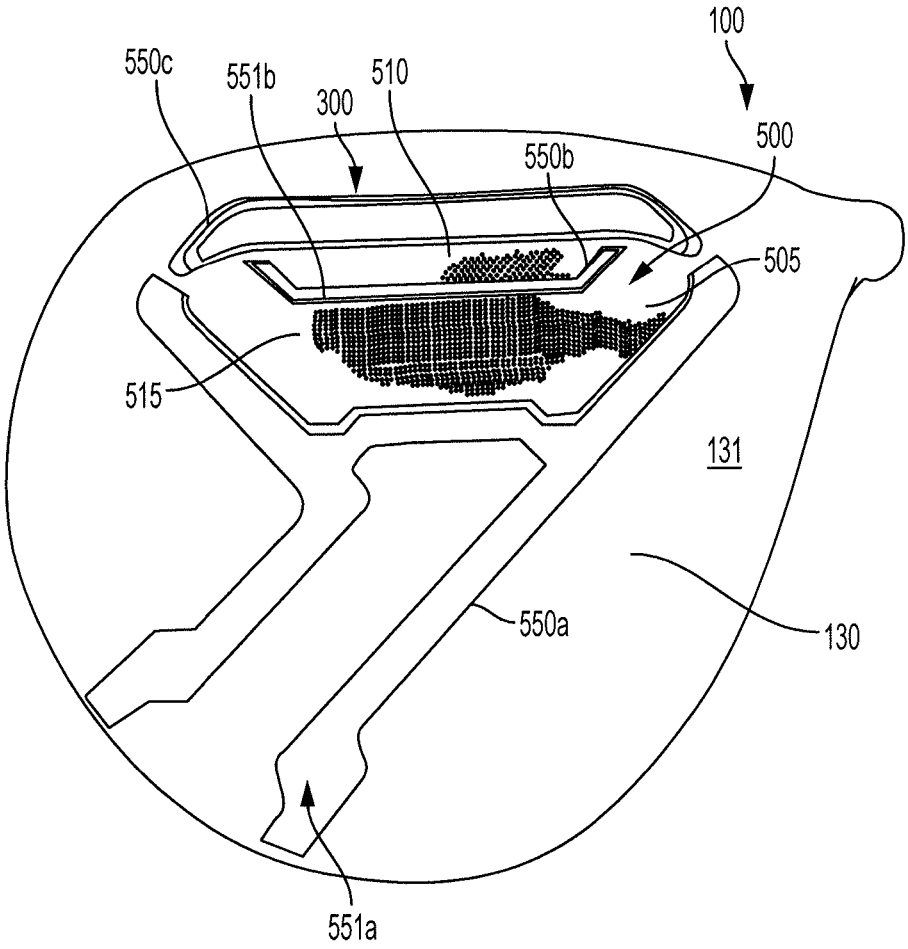
FIG. 4 is a bottom view of the golf club head of FIG. 1A including an annotated contact area.

As seen in FIG. 4, the contact area 500 includes a heelward portion 505, a central portion 510, and a toeward portion 515. The heelward portion 505 indicates the contact points of the sole 130 with the GP when the golf club head 100 is soled at a lie angle proximate the flattest lie angle 3198*c*. The toeward portion 515 indicates the contact points of the sole 130 with the GP when the golf club head 100 is soled at a lie angle proximate the upright-most lie angle 3198*a*. As can be seen, the heelward portion 505 and the toward portion 515 include much smaller contact areas than the central portion 510.

As can be seen with reference to FIG. 4, the sole 130 includes various concavities 550*a,b,c*. The concavities 550*a,b,c* include the BCF 300. The term "concavity" as used herein denotes any part of the sole 130 that is removed from a surface 131 of the sole sufficiently that it does not experience significant turf interaction. The concavities 550*a,b,c* provide cosmetic areas that are not subject to turf interaction, and, therefore, paint and decals may be placed within these areas without fear of wear. In general, the concavities are areas that include interior surfaces that are removed from the surface 131 by at least 0.5 mm. In the current embodiment, the concavities 550*a,b* include interior surfaces 551*a,b* that are removed from the surface 131 proximate the concavities 550*a,b* by about 1.0 mm, respectively. In various embodiments, various offsets may be used and would be understood by one of skill in the art. In the current embodiment, the BCF 300 defines a concavity 550*c* that does not include an interior surface, and the BCF 300 is filled with a material. As such, the filler material may withstand turf interaction, or it may be sufficiently recessed from the surface 131 that turf interaction is not considered for its analysis.

The bottom view of FIGS. 2 and 4 are of the golf club head 100 properly soled in accord with FIG. 1A, that is, having the score-line being about 0°±1.5° relative to the GP. The area viewed becomes the area of the sole and represents a 100% area of the sole, from which percentage surface covering can be determined.

Figure 5:
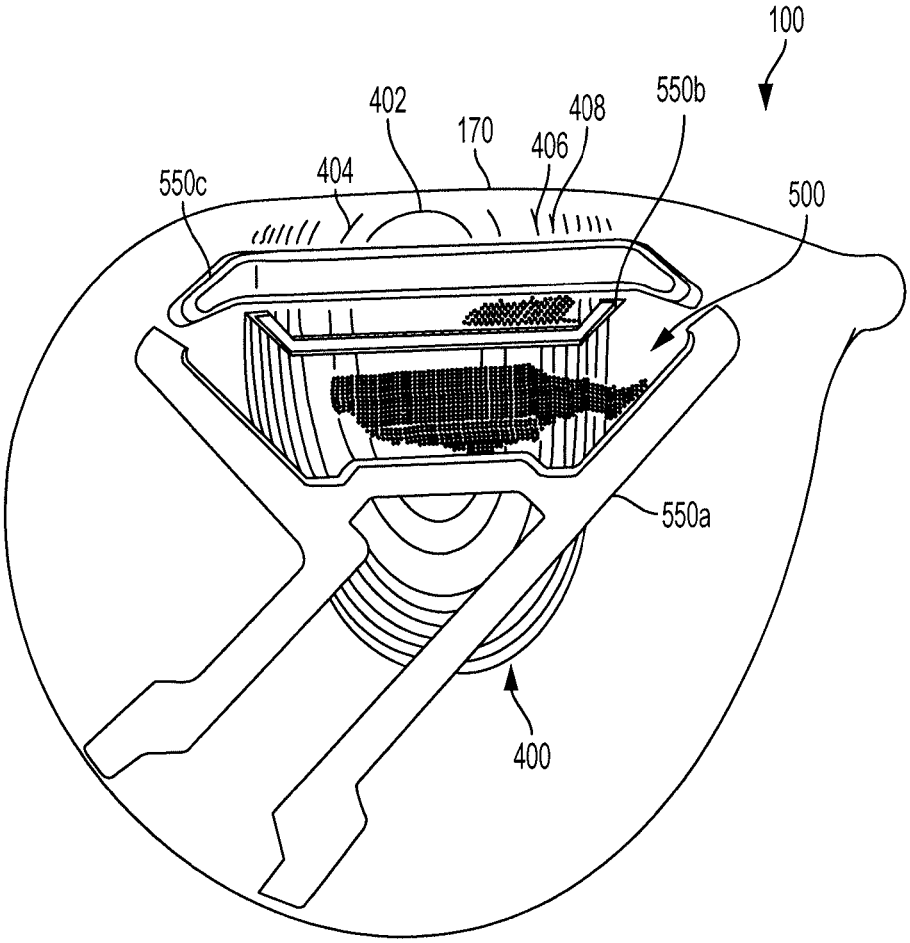
FIG. 5 is a bottom view of the golf club head of FIG. 1A including the contour plot of FIG. 2 and the annotated contact area of FIG. 4.

As seen with reference to FIG. 5, the contour plot 400 is overlaid onto the contact area 500. As can be seen, contact area 500 includes large regions of contact within the region 406 being within 1.5 mm of the GP. At least 60% of the contact area 500 falls within the region 406. In various embodiments, at least 70% of the contact area 500 falls within the region 406. In various embodiments, at least 80% of the contact area 500 falls within the region 406. In various embodiments, the region 408 may be utilized to determine the relationship. In various embodiments, the region 404 may be utilized to determine the relationship.

In various relationships, areas further than 1.5 inches from the leading edge should not be considered for analysis to determine whether paint coverage is viable. In the current embodiment, areas further than 2.0 inches fall outside of the region 404 within 1.0 mm of the GP. As such, in various embodiments, areas within 2.0 inches of the leading edge 170 may be subject to greater scrutiny than areas outside of 2.0 inches from the leading edge 170. For example, in the current embodiment, paint and decals should not be included within the region 406 within 1.5 mm of the GP for the area that is 2.0 inches from the leading edge 170; for areas greater than 2.0 inches from the leading edge, the region 402 within 0.5 mm of the GP is an appropriate region within which no surface covering should be placed, and areas outside the region 402 are sufficiently removed from the GP that wear should not be expected.

By following the recommendations above, it becomes possible to provide a surface covering over a relatively large percentage of the surface 131 of the sole 130—excluding concavities 550. In various embodiments, the surface covering may cover over 50% of the surface 131 of the sole 130 as projected in FIGS. 2, 4, and 5, excluding concavities 550. In various embodiments, over 60% coverage is achievable. In various embodiments, over 70% coverage is achievable. In various embodiments, over 80% coverage is achievable. In the current embodiment, over 90% paint coverage is achievable.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

We claim:

1. A golf club head comprising:

a golf club body, the golf club body including a crown as a top of the golf club body, a sole as a bottom of the golf club body comprising a ground contact area and at least one area outside the ground contact area, and a skirt connecting the crown to the sole, the golf club body occupying a volume of at least 150 cubic centimeters, the golf club body including a toe portion and a heel portion, the golf club body including a hosel connected to the heel portion, the golf club body defining an external surface area on the sole;

a face connected to a front of the golf club body;

a surface covering applied to at least 60% of the external surface area on the sole, but not to the ground contact area, wherein the ground contact area is defined as a region of the external surface area located within 1.0 mm of a ground plane when the golf club head is ideally positioned, the surface covering being applied over at least one of a manufacturing defect and a material porosity.

2. The golf club head of claim 1, wherein the surface covering is paint.

3. The golf club head of claim 1, wherein the surface covering includes at least one decal.

4. The golf club head of claim 3, wherein the decal includes a texture.

5. The golf club head of claim 1, wherein the surface covering is applied to at least 90% of the external surface area on the sole.

6. A golf club head comprising:

a golf club body, the golf club body including a crown as a top of the golf club body, a sole as a bottom of the golf club body, and a skirt connecting the crown to the sole, the golf club body occupying a volume of at least 150 cubic centimeters, the golf club body including a toe portion and a heel portion, the golf club body including a hosel connected to the heel portion, the golf club body defining an external surface area on the sole, the golf club body defining a leading edge being located at a front of the golf club body;

a face connected to a front of the golf club body; and a surface covering applied to at least a portion of the external surface area on the sole, wherein the external surface area on the sole includes at least one approximate contact portion that is located within 1.0 mm of a ground plane when the golf club head is ideally positioned, wherein at least 50% of the external surface area on the sole includes the surface covering, and wherein the surface covering on the external surface area on the sole is included only on any portions of the sole outside of the approximate contact portion.

7. The golf club head of claim 6, wherein the surface covering is applied to at least 90% of the external surface area on the sole.

8. The golf club head of claim 6, wherein the approximate contact portion is defined as the surface area within 1.5 mm of a ground plane when the golf club head is ideally positioned.

9. The golf club head of claim 6, wherein the approximate contact portion is defined as the surface area within 2.0 mm of a ground plane when the golf club head is ideally positioned.

10. The golf club head of claim 6, wherein the approximate contact portion is defined as the surface area within 1.0 mm of a ground plane and within 2.0 inches of the leading edge when the golf club head is ideally positioned.

11. The golf club head of claim 6, wherein the approximate contact portion is defined as the surface area within 2.0 mm of a ground plane and within 2.0 inches of the leading edge when the golf club head is ideally positioned.

12. The golf club head of claim 6, wherein the approximate contact portion is defined as the surface area within 1.5 mm of a ground plane and within 1.5 inches of the leading edge when the golf club head is ideally positioned.

13. The golf club head of claim 6, the surface covering being applied over at least one of a manufacturing defect and a material porosity.

14. The golf club head of claim 13, wherein the surface covering is at least one of a decal and paint.

15. The golf club head of claim 13, wherein the surface covering includes a rough texture.

16. The golf club head of claim 13, wherein the surface covering includes a texture.

17. A method of manufacture comprising:

obtaining a golf club head casting, the golf club head casting including a crown, a sole, a skirt connecting the crown to the sole, and a face, the golf club head casting including at least one of a porosity and a manufacturing defect; and applying a surface covering to at least a portion of an external surface on the sole of the golf club head, wherein the portion covered includes at least one of the porosity and the manufacturing defect, wherein at least one of the porosity and the manufacturing defect does not include a filling material;

wherein the portion covered includes a majority of, but substantially less than all of, the sole of the golf club head casting, wherein the surface covering applied to the sole is applied solely to an area of the sole outside of an approximate contact portion, defined as a region of the external surface area of the sole located within 1.0 mm of a ground plane when the golf club head is ideally positioned, and wherein the surface covering includes a texture.

18. The method of claim 17, further comprising the step of polishing the crown.

19. The method of claim 18, further comprising the step of filling at least one porosity on the crown.

20. The method of claim 19, wherein the surface covering of the crown is the same as the surface covering of the sole.

* * * * *